US006311539B1

(12) United States Patent
Yeo et al.

(10) Patent No.: US 6,311,539 B1
(45) Date of Patent: Nov. 6, 2001

(54) METHOD FOR CALIBRATING AN EDGE DETECTION SYSTEM IN A FRICTION DRIVE APPARATUS

(75) Inventors: Daren Yeo, Stafford; Patrick Raiola, Durham; Kenneth O. Wood, West Stafford, all of CT (US)

(73) Assignee: Gerber Scientific Products, Inc., Manchester, CT (US)

( * ) Notice: Subject to any disclaimer, the term of this patent is extended or adjusted under 35 U.S.C. 154(b) by 0 days.

(21) Appl. No.: 09/546,137

(22) Filed: Apr. 10, 2000

Related U.S. Application Data

(62) Division of application No. 09/217,667, filed on Dec. 21, 1998.

(51) Int. Cl.[7] ..... G01B 21/00; G01B 121/04; B65H 43/00

(52) U.S. Cl. ..... 73/1.79; 226/3; 250/252.1; 250/559.1; 702/87; 702/94

(58) Field of Search ..... 73/1.79, 1.88; 702/87, 94, 90, 91, 104, 105; 250/252.1 A, 559.1; 226/3, 15, 17, 45

(56) References Cited

U.S. PATENT DOCUMENTS

| | | | | |
|---|---|---|---|---|
| 3,240,410 | * | 3/1966 | Jacobsen | 226/3 |
| 3,370,771 | * | 2/1968 | Shay | 226/3 X |
| 4,158,171 | * | 6/1979 | Abbe et al. | 324/754 |
| 4,500,045 | * | 2/1985 | Whitaker et al. | 226/20 X |
| 4,528,630 | * | 7/1985 | Sargent | 702/94 X |
| 4,731,622 | * | 3/1988 | Hicks et al. | 347/116 |
| 5,119,981 | * | 6/1992 | Gnuechtel et al. | 226/15 |
| 5,270,646 | * | 12/1993 | Kihlberg et al. | 324/207.16 |
| 5,327,770 | * | 7/1994 | Hindle | 73/1.88 X |
| 5,730,643 | * | 3/1998 | Bartlett et al. | 451/8 |
| 5,876,131 | * | 3/1999 | Parker et al. | 400/279 |
| 5,977,766 | * | 11/1999 | Linder et al. | 324/225 |
| 6,035,695 | * | 3/2000 | Kim | 73/1.79 |

FOREIGN PATENT DOCUMENTS

| | | | | |
|---|---|---|---|---|
| 5-209740 | * | 8/1993 | (JP) . | |
| 1402799 A1 | * | 6/1988 | (SU) | 73/1.79 |

OTHER PUBLICATIONS

Derwent Acc No. 1984–262097, Abstract of SU1075073A Igumnov et al "Rolled Product Length Meter–", Feb. 1984.*

Derwent Acc No. 1989–278717, Abstract of DD267240A Probst et al "Sensor for Edges of Lengths of Material–", Apr. 1989.*

Derwent Acc No. 1991–250728, Abstract of SU–1596212A & Clipped Image Burdun et al "Rolled Stip Width Measurement Unit–", Sep. 1990.*

* cited by examiner

*Primary Examiner*—Thomas P. Noland
(74) *Attorney, Agent, or Firm*—McCormick, Paulding & Huber LLP

(57) ABSTRACT

A friction drive apparatus includes an edge detection system for determining a lateral position of a strip material advancing in a longitudinal direction. The edge detection system includes a first sensor and a second sensor for monitoring the lateral position of the strip material. The friction drive apparatus also includes instructions for automatically aligning the strip material as the strip material is advanced a predetermined aligning distance and instructions for calibrating the second sensor with respect to the first sensor to compensate for any potential discrepancies therebetween. The apparatus and methods of the present invention ensure that the strip material is properly aligned in the friction drive apparatus and limit waste of strip material during those operations.

9 Claims, 7 Drawing Sheets

METHOD FOR CALIBRATING AN EDGE DETECTION SYSTEM IN A FRICTION DRIVE APPARATUS

This application is a divisional of U.S. patent application No. 09/217,667, filed on Dec. 21, 1998.

The present invention relates to friction drive apparatus such as printers, plotters and cutters that feed strip material for producing graphic images and, more particularly, to a method for calibration of friction drive apparatus and a method for automatic alignment of strip material therein.

BACKGROUND OF THE INVENTION

Friction, grit, or grid drive systems for moving strips or webs of sheet material longitudinally back and forth along a feed path through a plotting, printing, or cutting device are well known in the art. In such drive systems, friction (or grit or grid) wheels are placed on one side of the strip of sheet material (generally vinyl or paper) and pinch rollers, of rubber or other flexible material, are placed on the other side of the strip, with spring pressure urging the pinch rollers and material against the friction wheels. During plotting, printing, or cutting, the strip material is driven back and forth, in the longitudinal or X-direction, by the friction wheels while, at the same time, a pen, printing head, or cutting blade is driven over the strip material in the lateral or Y-direction.

These systems have gained substantial favor due to their ability to accept plain (unperforated) strips of material in differing widths. However, the existing friction drive apparatus experience several problems. One problem that occurs in friction drive apparatus is a skew error. The skew error will arise as a result of strip material being driven unevenly between its two longitudinal edges, causing the strip material to assume a cocked position. The error is integrated in the lateral or Y-direction and produces an increasing lateral position error as the strip material moves along the X-direction. The error is often visible when the start of one object must align with the end of a previously plotted object. In the worst case, such lateral errors result in the strip drifting completely off the friction wheel. The skew error is highly undesirable because the resultant graphic image is usually destroyed.

Most material strips are inserted manually into the friction drive systems. During the manual insertion, it is essentially impossible to place the material strip perfectly straight in the friction drive apparatus. Therefore, the existing systems typically use at least three feet of strip material until the strip material is straightened with respect to the friction drive apparatus. This manual alignment procedure has numerous drawbacks. First, it results in excessive material consumption and waste thereof. Second, the procedure is time consuming. Additionally, manual alignment is not always effective. Therefore, there is a need to reduce wasteful consumption of strip material during loading thereof into the friction drive apparatus and to ensure proper alignment of the strip material within the friction drive apparatus during operation.

SUMMARY OF THE INVENTION

It is an object of the present invention to provide an apparatus and a method for automatically aligning strip material in a friction drive apparatus at the onset of an operation without excessive strip material waste.

It is another object of the present invention to provide an apparatus and a method for properly calibrating two sensors that detect an edge of the strip material in the friction drive apparatus with respect to each other.

According to the present invention, a friction drive apparatus includes an edge detection system having a first sensor and a second sensor for determining a lateral position of a longitudinal edge of a strip material. The friction drive apparatus also includes first and second friction wheels advancing the strip material in a longitudinal direction that are rotated by independently driven motors which are driven independently in response to position of the longitudinal edge of the strip material detected by the sensor disposed behind the friction wheels with respect to the direction of motion of the strip material.

The friction drive apparatus also includes instructions for automatically aligning the strip material in the friction drive apparatus upon loading of the strip material and instructions for calibrating the second sensor with respect to the first sensor of the edge detection system. The automatic alignment procedure includes steps of advancing the strip material in the longitudinal direction a predetermined aligning amount while the strip-material is steered with respect to the controlling sensor to eliminate any lateral deviations of the strip material from the feed path. The calibration procedure calibrates the second sensor with respect to the first sensor to eliminate any potential offset that may have been introduced during assembly and installation of the sensors.

One advantage of the present invention is that it eliminates the need for an operator to manually align the strip material. The automatic alignment reduces the amount of wasted strip material as compared to a manual alignment operation and results in time savings and improved quality of the final graphic product. Another advantage of the present invention is that the calibration procedure provides additional accuracy to the proper alignment of the strip material and also improves quality of the final graphic product.

The foregoing and other advantages of the present invention become more apparent in light of the following detailed description of the exemplary embodiments thereof, as illustrated in the accompanying drawings.

DESCRIPTION OF THE PREFERRED EMBODIMENT

Figure 1:
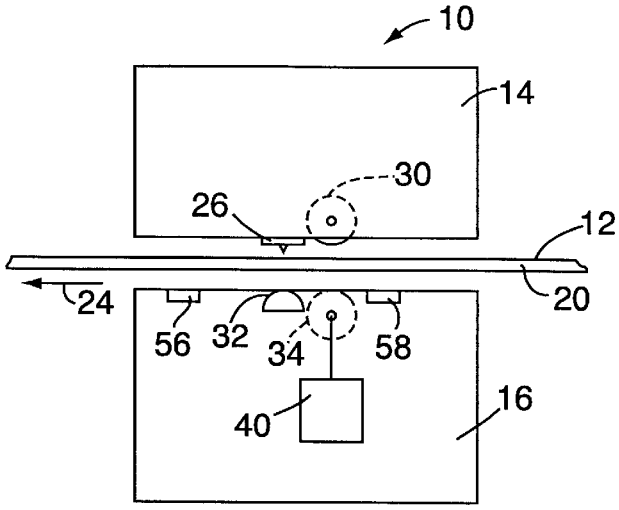
FIG. 1 is an exploded side elevational view schematically showing a friction drive apparatus, according to the present invention.
Figure 2:
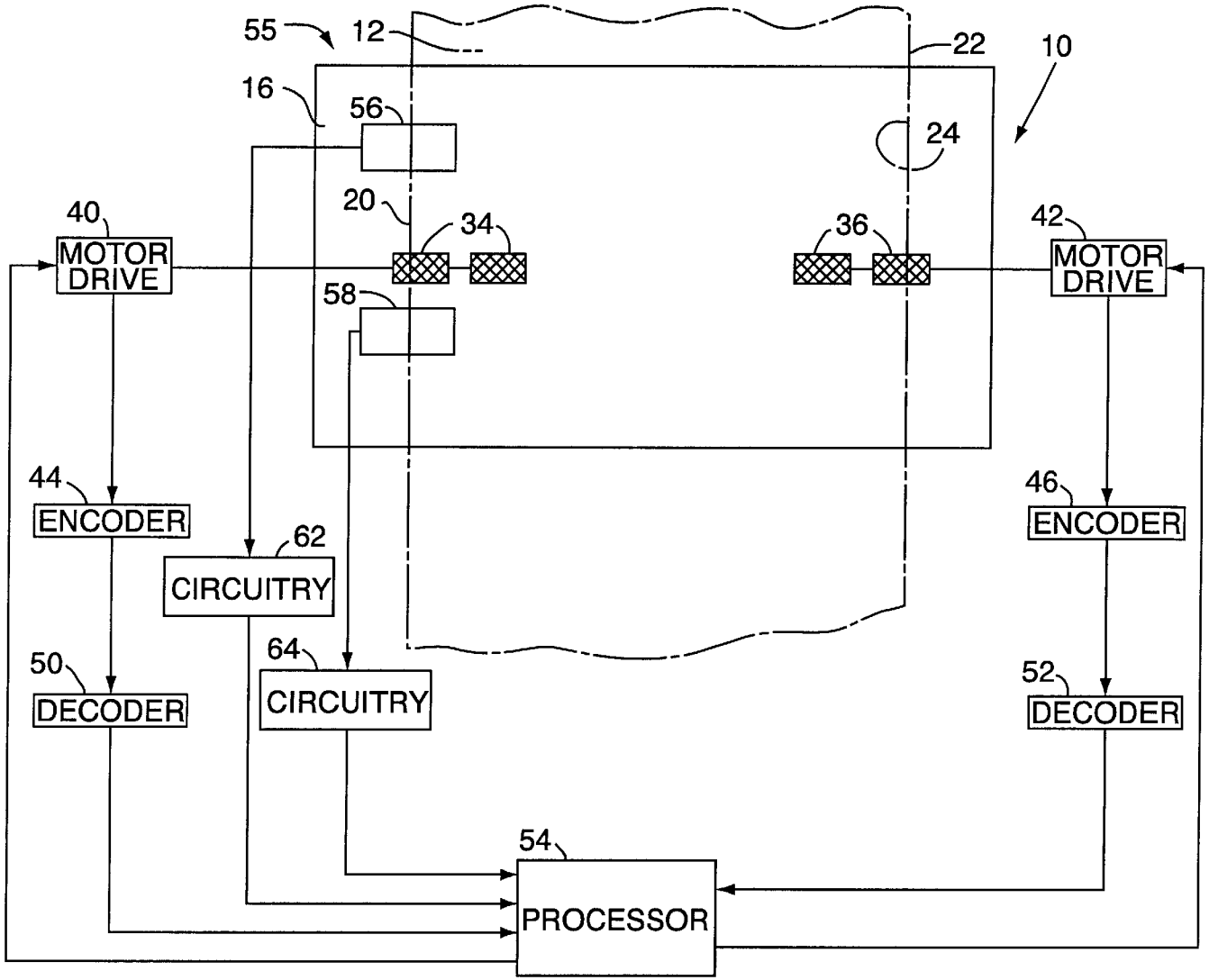
FIG. 2 is a schematic plan view of a bottom portion of the friction drive apparatus of FIG. 1 with the strip material shown in phantom.

Referring to FIG. 1, an apparatus 10 for plotting, printing, or cutting strip material 12 includes a top portion 14 and a bottom portion 16. The strip material 12, having longitudinal edges 20, 22, as best seen in FIG. 2, is moving in a longitudinal or X-direction along a feed path 24. The top portion 14 of the apparatus 10 includes a tool head 26 movable in a lateral or Y-direction perpendicular to the X-direction and the feed path 24. The top portion 14 also includes a plurality of pinch rollers 30 that are disposed along the longitudinal edges 20, 22 of the strip material 12. The bottom portion 16 of the apparatus 10 includes a stationary or roller platen 32, disposed in register with the tool head 26, and a plurality of friction wheels 34, 36, disposed in register with the pinch rollers 30.

Referring to FIG. 2, each friction wheel 34, 36 has a surface for engaging the strip material 12, and is driven by a motor drive 40, 42, respectively. Each motor drive 40, 42 may be a servo-motor with a drive shaft connected to a shaft encoder 44, 46 for detecting rotation of the drive shaft. Each encoder 44, 46 is connected to a decoder 50, 52, respectively. Each decoder 50, 52 is in communication with a processor 54. The apparatus 10 also includes an edge detection system 55 that operates in conjunction with the motors 40, 42 to automatically align the strip material 12 and to minimize skew error during operation. The edge detection system 55 includes a first sensor 56 and a second sensor 58 for tracking the longitudinal edge 20 of the strip material 12, with sensors 56, 58 being disposed on opposite sides of the friction wheels 34, 36. Each sensor 56, 58 is in communication with the processor 54 via associated circuitry 62, 64, respectively. The processor 54 also communicates with each motor drive 40,42 to complete a closed loop system.

Figure 3:
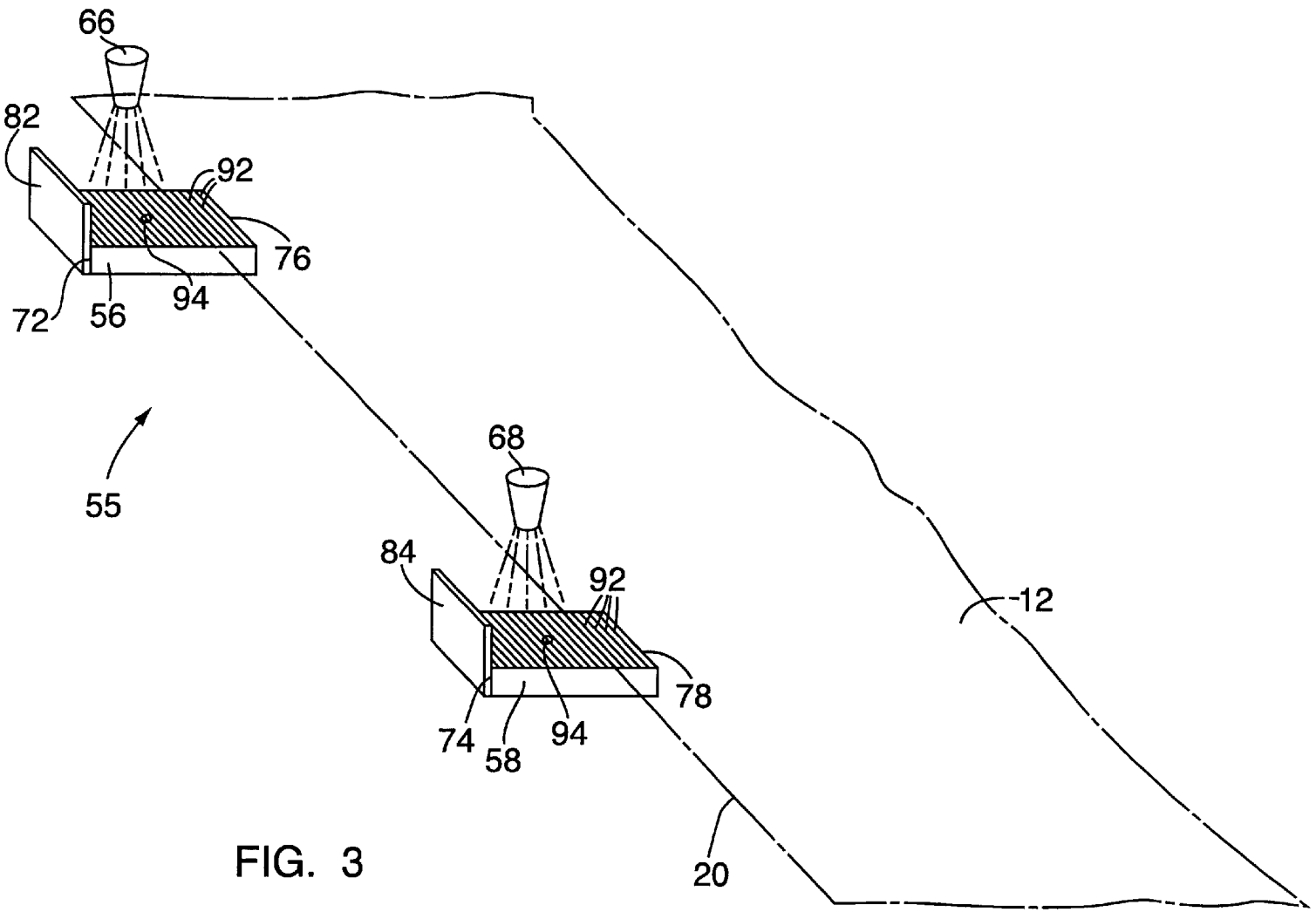
FIG. 3 is a schematic, perspective view of an edge detection system of the friction drive apparatus of FIG. 2 with the strip material shown in phantom.

Referring to FIG. 3, the edge detection system 55 further includes a first light source 66 and a second light source 68 positioned substantially above the first and second sensors 56, 58, respectively. Each sensor 56, 58 includes a first and second outer edges 72, 74 and first and second inner edges 76, 78, respectively, with first and second stops 82, 84 disposed substantially adjacent to each respective outer edge 72, 74. In the preferred embodiment of the present invention each sensor 56, 58 includes a plurality of pixels 92 arranged in a linear array with a central pixel 94 being disposed in the center of the plurality of pixels 92 and defined to be a center reference position. Also, in the preferred embodiment of the present invention, the associated circuitry 62, 64 includes a pulse shaper and a serial to parallel converter (not shown).

During normal operation, as the strip material 12 is fed along the feed path 24 in the longitudinal or X-direction, the friction wheels 34, 36 and the pinch rollers 30 are urged together and engage the strip material 12, as best seen in FIGS. 1 and 2. The motor drives 40, 42 rotate the friction wheels 34, 36, respectively, at substantially the same speed to ensure that both longitudinal edges 20, 22 of the strip material 12 progress along the feed path 24 in the X-direction simultaneously. As the strip material 12 moves in the longitudinal or X-direction, the tool head 26 moves in a lateral or Y-direction, either plotting, printing, or cutting the strip material depending on the specific type of the tool employed.

Figure 4:
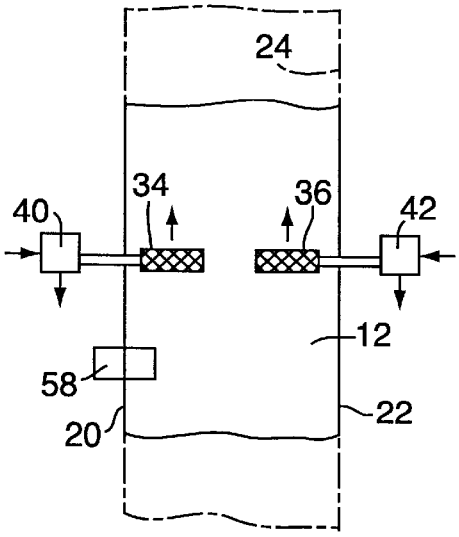
FIG. 4 is a schematic representation of a strip material moving properly along a feed path for the strip material in the friction drive apparatus of FIG. 2.

The sensor 58, disposed behind the friction wheels 34, 36 with respect to the strip material motion indicated by the arrow, detects and ensures that the strip material 12 does not move laterally in the Y-direction. Referring to FIG. 3, each pixel 92 that is exposed to light emitted from the light source 68 generates photo current, which is then integrated. A logic "one" from each pixel 92 indicates presence of light. Pixels that are shielded from light by the strip material 12, do not generate photo current and result in a logic reading of "zero". A bit shift register (not shown) outputs serial data, one bit for each pixel starting with the first pixel, adjacent to the outer edge 74 of the sensor 58. The output is then shaped and input into a counter (not shown). The counter counts until the serial data reaches at least two logic "zeros" in succession. Two logic "zeros" in succession indicate that the edge 20 of the strip material 12 has been reached and the counter is stopped. The position of the edge 20 of the strip material 12 is then established and used to reposition the strip material 12. This procedure is repeated every predetermined time interval. In the preferred embodiment of the present invention, the predetermined time interval is approximately every 250 micro-seconds. Thus, with proper longitudinal positioning of the strip material, that is, with no Y-position error, the sensor 58 is half covered, and the motor drives 40, 42 rotate friction wheels 34, 36 simultaneously at the same speed, as shown in FIG. 4.

Figure 5:
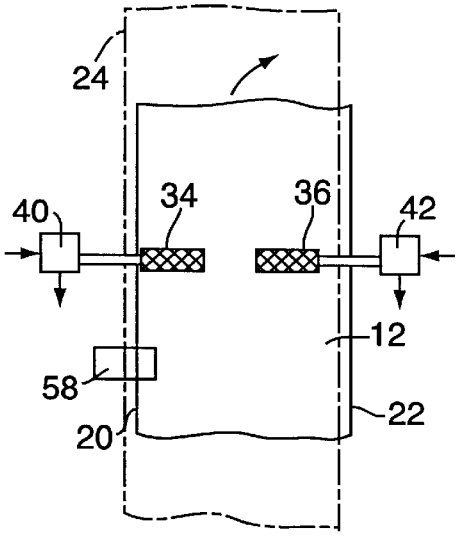
FIG. 5 is a schematic representation of the strip material deviating from the feed path of FIG. 4 and a correction initiated by adjusting the relative speeds of drive motors.

Referring to FIG. 5, a Y-position error occurs when the strip material 12, for example, moves to the right exposing more than one half of the sensor 58. When more than one half of the sensor 58 is exposed, the sensor 58 and its associated circuitry generate a positional output to the processor 54 via the associated circuitry 64, as best seen in FIG. 2, indicating that the strip material 12 is shifted to the right. Once the processor 54 receives such a positional output from the sensor 58, the processor 54 imposes a differential signal on the signals to the motor drives 40, 42 to increase the speed of the motor drive 40, driving friction wheel 34, and to decrease the speed of the motor drive 42, driving friction wheel 36. The differential signal and resulting differential velocities of the friction wheels vary in proportion to the Y-direction error detected by the sensor 58. As the motor drives 40, 42 rotate friction wheels 34, 36 at different speeds, the front portion of strip material 12 is skewed to the right, as indicated by the arrow, and the rear portion of the strip material is skewed to the left to cover a greater portion of the sensor 58. As the skewed strip material 12 continues to move in a longitudinal or X-direction, more of the sensor 58 becomes covered.

Figure 6:
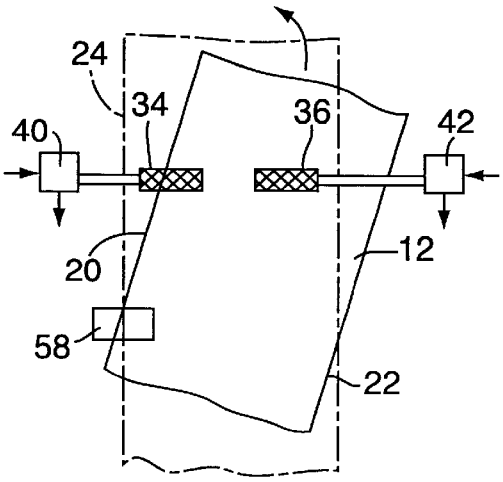
FIG. 6 is a schematic representation of the strip material deviating from the feed path of FIG. 4 and a further correction initiated by adjusting the relative speeds of the drive motors.

When half of the sensor 58 is covered, as shown in FIG. 6, the sensor 58 indicates that it is half-covered and the motor processor 54 reduces the differential signal to zero. At this instant, the strip material 12 is skewed as shown, but moves directly forward in the X-direction because the motor drives 40, 42 are driving the friction wheels at the same speed. In effect, the skewed position of the strip material causes the Y-position error at the sensor 58 to be integrated as the strip material moves forward in the X-direction. Once an area greater than one half of the sensor 58 is covered, the sensor 58 sends a signal to the processor 54 indicating that more than half of the sensor 58 is covered and the processor 54 imposes a differential signal on the signals to the motor drives 40, 42 to decrease the speed of the motor drive 40 and friction wheel 34 and increase the speed of the motor drive 42 and friction wheel 36. The difference in rotational speeds of the friction wheels 34, 36 now turns and skews the strip material to the left, in the direction of the slower rotating friction wheel 34, as indicated by the arrow, which begins to uncover sensor 58. The differential rotational speed of the friction wheels 34, 36 continues until the strip material 12 covers only one half of the sensor 58 and the differential signal from the processor fades out. The processor 54 then applies equal drive signals to the motor drives 40, 42 and the friction wheels 34, 36 are driven at the same rotational speed.

The strip material 12 again moves in the X-direction. If at this time the strip material is still skewed in the Y-direction, because the processor is under-damped or over-damped, the forward motion in the X-direction will again integrate the Y-position error and the sensor 58 will signal the processor to shift the strip material back to a central position over the sensor 58 with corrective skewing motions as described above. The skewing motions will have the same or opposite direction depending upon the direction of the Y-position error.

When the feed of the strip material 12 in the X-direction is reversed, control of the Y-position error is switched by the processor 54 from the sensor 58 to the sensor 56, which now disposed behind the friction wheels 34, 36 with respect to the strip material 12 motion. The Y-position error is then detected at the sensor 56, but is otherwise controlled in the same manner as described above.

To avoid sudden jumps in either plotting, printing, or cutting operations, the increasing or decreasing speed commands are incremental. Small increments are preferred so that the error is corrected gradually.

Figure 10:
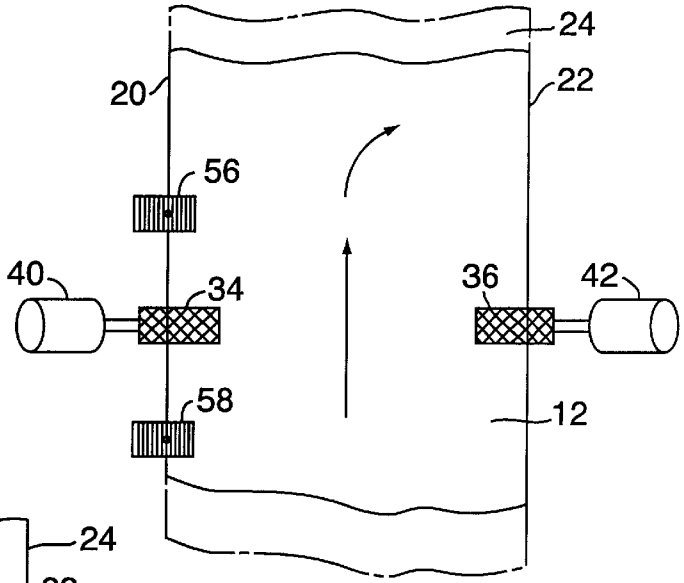
FIG. 10 is a schematic representation of the strip material being further steered into a proper alignment position in accordance with the automatic alignment procedure of FIG. 8.
Figure 9:
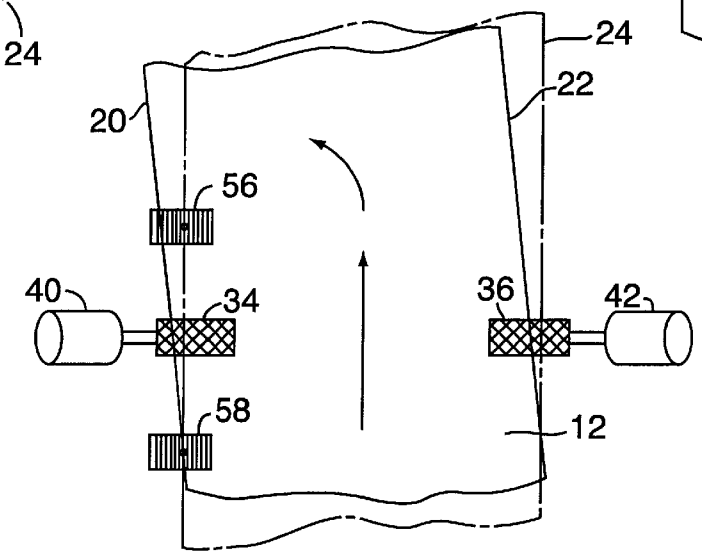
FIG. 9 is a schematic representation of the strip material being steered into a proper alignment position in accordance with the automatic alignment procedure of FIG. 8.
Figure 7:
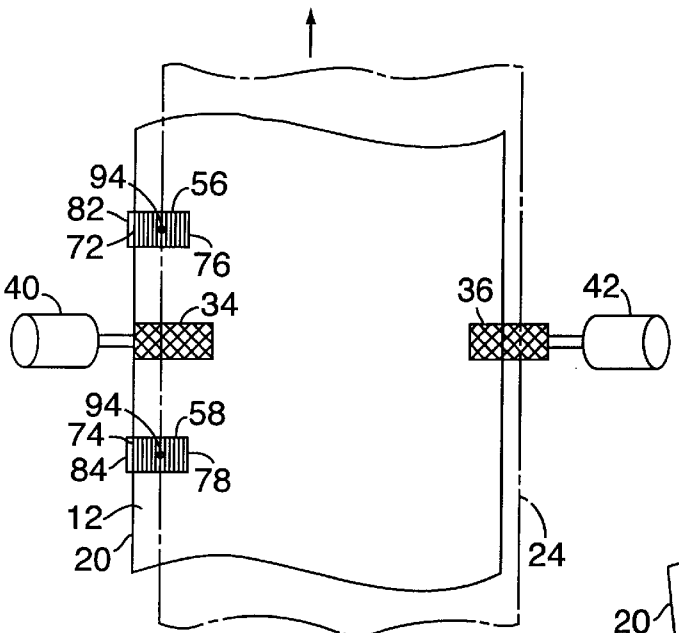
FIG. 7 is a schematic representation of the strip material being loaded into the friction drive apparatus of FIG. 1.
Figure 8:
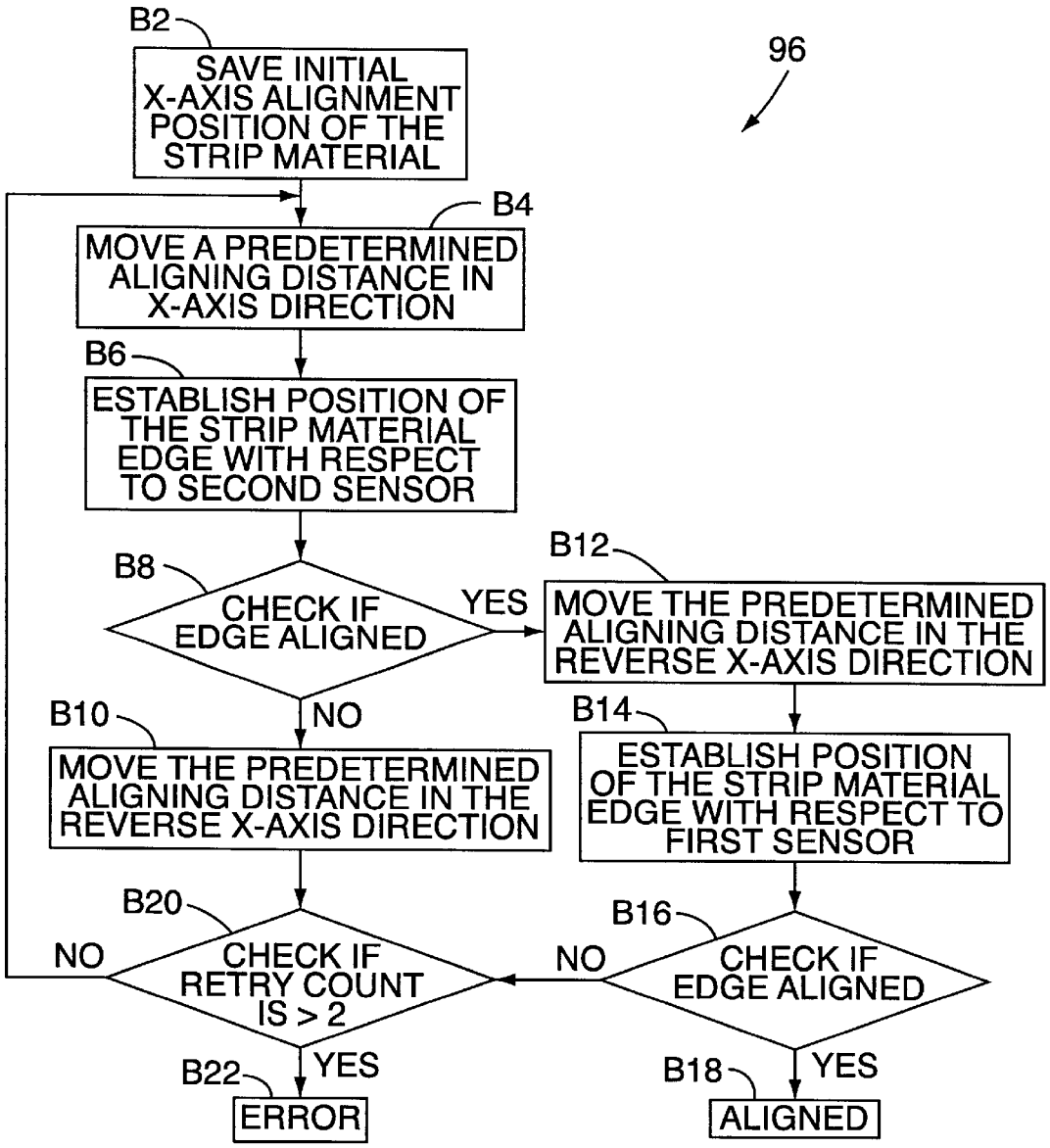
FIG. 8 is a high level logic diagram of an automatic alignment procedure of the strip material subsequent to being loaded into the friction drive apparatus as shown in FIG. 7.

Referring to FIG. 7, the strip material 12 is loaded into the friction drive apparatus 10 and automatically aligned prior to starting an operation. The strip material 12 is placed into the friction drive apparatus 10 such that the first longitudinal edge 20 of the strip material 12 is in contact with the first and second stops 82, 84. In that position, the strip material 12 is covering more than half of both the first and second sensors 56, 58. The friction drive apparatus 10 is then turned on to perform an automatic alignment procedure 96 resident in memory, as shown in FIG. 8. First, the friction drive apparatus 10 saves the initial X-axis alignment position of the strip material 12, as indicated by B2. Then, the friction drive apparatus 10 advances the strip material 12 a predetermined aligning distance, steering the strip material in accordance with the above steering procedure, as indicated by B4 and shown in FIGS. 9 and 10.

In the preferred embodiment of the present invention, the strip material 12 is displaced approximately twelve inches (12"). As the strip material 12 is advanced forward the predetermined aligning distance, the exact position of the first longitudinal edge 20 of the strip material 12 with respect to the second sensor 58 is continuously monitored. In the preferred embodiment of the present invention, the exact position of the first longitudinal edge 20 is checked approximately every two hundred fifty (250) micro-seconds with the processor 54 retrieving the information from the sensors approximately every millisecond. At the end of the movement of the strip material 12 the predetermined aligning distance, if the first longitudinal edge 20 of the strip material 12 has been centered with respect to the second sensor 58, at least a minimum number of times during the periodic checks, the friction drive apparatus 10 is to assume that the strip material 12 is aligned with respect to the second sensor 58, as indicated by B6, B8.

If the first longitudinal edge 20 of the strip material 12 is not aligned when the strip material 12 is advanced the predetermined aligning distance, the strip material feed direction is reversed and the strip material 12 is returned to its original position, as indicated by B10. If the edge 20 is aligned, the friction drive apparatus 10 displaces the strip material 12 the predetermined aligning distance in a reverse direction to the initial X-axis position that was previously saved, as indicated by B12. During the reverse movement, the strip material 12 is shifted in accordance with the above steering scheme by the first sensor 56. Thus, the friction drive apparatus 10 monitors and saves the exact position of the first longitudinal edge 20 of the strip material 12 with respect to the first sensor 56, as indicated by B14. In the preferred embodiment of the present invention, processor 54 of the friction drive apparatus checks the exact position of the first longitudinal edge 20 of the strip material 12 every millisecond during the reverse advance of the strip material 12. If the first longitudinal edge 20 of the strip material 12 has been centered with respect to the first sensor 56 for at least a minimum number of times, the friction drive apparatus 10 is to assume that the strip material 12 is aligned with respect to the first sensor 56, as indicated by B16. If it was determined that the strip material is aligned with respect to the first sensor 56, the procedure is completed, as indicated by B18.

If the first longitudinal edge of the strip material 12 is not aligned with respect to the first sensor 56, the result is that the strip material 12 is not aligned. If it was determined that the strip material 12 is not aligned, as indicated by B20, the automatic alignment procedure 96 is repeated. In the preferred embodiment of the present invention, the automatic alignment procedure 96 is repeated three (3) times before an error signal is displayed, as indicated by B22. Every time the automatic alignment procedure is performed, the internal counter is incremented by one (not shown). Typically, the friction drive apparatus 10 according to the present invention, does align the strip material 12 within the three (3) attempts.

Although the automatic alignment procedure 96 ensures that the strip material 12 is substantially parallel to the feed path 24 and is centered with respect to the controlling sensor, the first time the automatic alignment procedure 96 is activated in the friction drive apparatus 10, it does not ensure that the first and second sensors 56, 58 are calibrated with respect to each other and therefore does not ensure that when the direction of strip material feed is reversed the graphic lines coincide.

Figure 11:
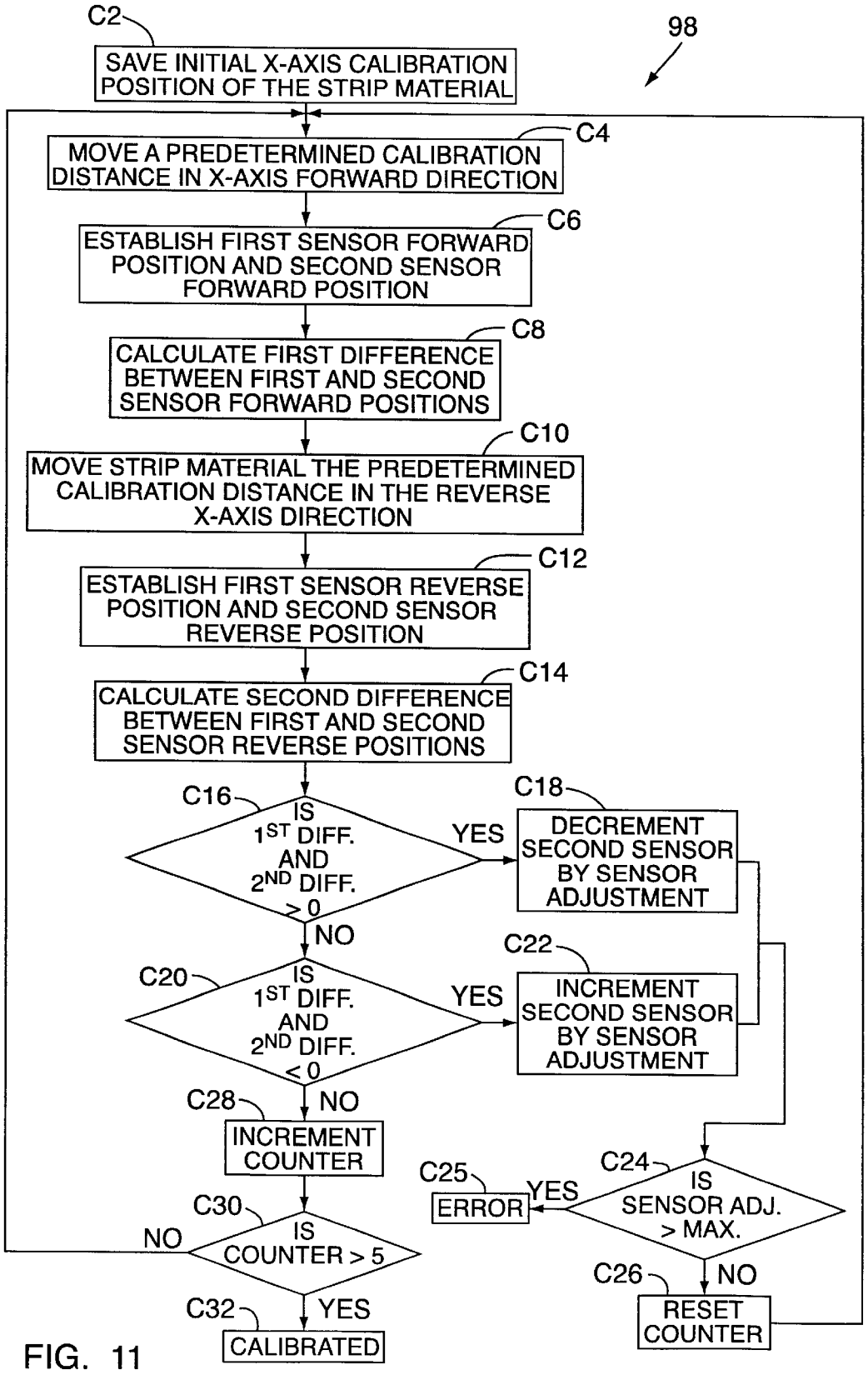
FIG. 11 is a high level logic diagram of a calibration procedure for the edge detection system of the friction drive apparatus of FIG. 1.

Referring to FIG. 11, a sensor calibration procedure 98, resident in memory, ensures that the first and second sensors 56, 58 are calibrated with respect to each other at the onset of the friction drive apparatus operation. Subsequent to the initial automatic alignment procedure 96, the initial X-axis calibration position of the strip material 12 is saved, as indicated by C2. The strip material 12 is then advanced forward a predetermined calibration distance in the X-axis direction, as indicated by C4. In the preferred embodiment, the predetermined calibration distance is approximately sixteen inches (16"). As the strip material 12 is advanced forward, the friction drive apparatus 10 steers the strip material 12 to maintain proper alignment with respect to the second sensor 58 in accordance with the above lateral error correcting scheme. Once the strip material 12 has been advanced the predetermined calibration distance, the first and second sensors 56, 58 are read to establish a first sensor forward position and a second sensor forward position, as indicated by C6. Subsequently, a first difference is taken between the first sensor forward position and the second sensor forward position, as indicated by C8. Then, the strip material 12 is advanced the predetermined calibration distance in a reverse X-axis direction to the saved X-axis calibration position, as indicated by C10, with the lateral error correction scheme maintaining the strip material 12 aligned with respect to the first sensor 56. Once the strip material 12 is returned to its original position, the first and second sensor positions are read again to establish a first sensor reverse position and a second sensor reverse position, as indicated by C12. Then, a second difference is calculated between the first sensor reverse position and the second sensor reverse position, as indicated by C14. Subsequently, the second sensor 58 is adjusted by a sensor adjustment such that the center reference position of the second sensor 58 is decremented if the first difference and the second difference are both positive and incremented if the first difference and the second difference are both negative, as indicated by C16, C18 and C20, C22, respectively.

The new adjusted second sensor 58 position reflects an offset, if any, between the center pixel 94 of the first sensor 56 and the center pixel 94 of the second sensor 58 that was potentially introduced during assembly and installation of the sensors 56, 58.

In the preferred embodiment of the present invention, the sensor adjustment is an average of the first and second differences. Thus, the center reference position 94 of the second sensor 58 is moved from the central pixel either toward the outer edge 74 or the inner edge 78 by a certain number of pixels, as established by the sensor adjustment. However, although the preferred embodiment of the present invention defines the sensor adjustment to be an average of the first and second differences, the sensor adjustment can be defined to equal to the first difference.

Subsequent to incrementing or decrementing the center position 94 of the second sensor 58 by the sensor adjustment, the sensor adjustment is compared to a maximum threshold adjustment, as indicated by C24. If the sensor adjustment exceeds the maximum threshold adjustment, then there is an error, as indicated by C25. If the sensor adjustment is smaller than the minimum threshold adjustment, then the counter is reset as indicated by C26, and the calibration procedure is repeated. The maximum threshold adjustment is provided to ensure that the sensor adjustment does not shift the center reference position of the sensor 58 too far from the center of the sensor 58, thereby inhibiting steering ability of the sensor 58.

However, if the first difference and the second difference are substantially zero, then the counter is incremented, as indicated by C28, and checked if it exceeds five, as indicated by C30. If the counter exceeds five, then the calibration is completed, as indicated by C32. However, if the counter is less than five, the calibration procedure 98 is repeated until there is no substantial difference between the readings of sensors 56, 58 at least five times in a row.

Once the second sensor adjustment is determined, the microprocessor applies the adjustment to the second sensor 58 in all subsequent operations.

Figure 12:
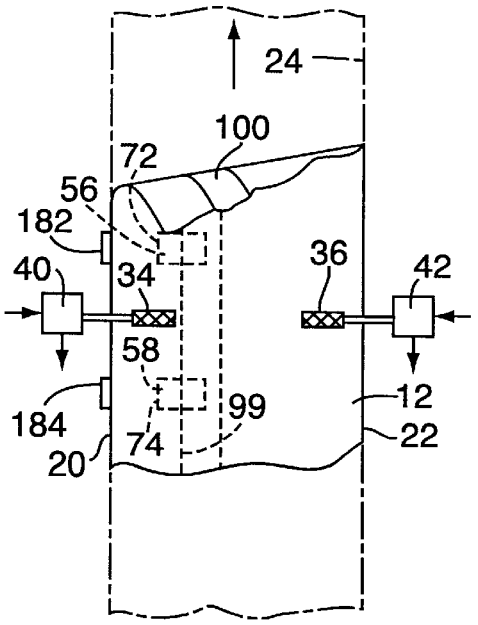
FIG. 12 is a schematic representation of an alternate embodiment of the edge detection system with the strip material moving along the feed path in the drive apparatus of FIG. 1.

Referring to FIG. 12, in an alternate embodiment, sensors 56, 58 can be positioned along an edge 99 of a stripe 100 marked on the underside of the strip material 12. The stripe 100 is spaced away in a lateral direction from either of the longitudinal edges 20, 22 of the strip material 12 and extends in the longitudinal direction. The Y-position error is detected by the sensors 56, 58 and corrected in the manner described above with the edge 99 of the stripe 100 functioning analogously to the longitudinal edge 20 of the strip material 12. The automatic alignment procedure 96 and the calibration procedure 98 are performed analogously with the stops 182, 184 being spaced away from the outer edges 72, 74 of the sensors 56, 58, respectively.

Figure 13:
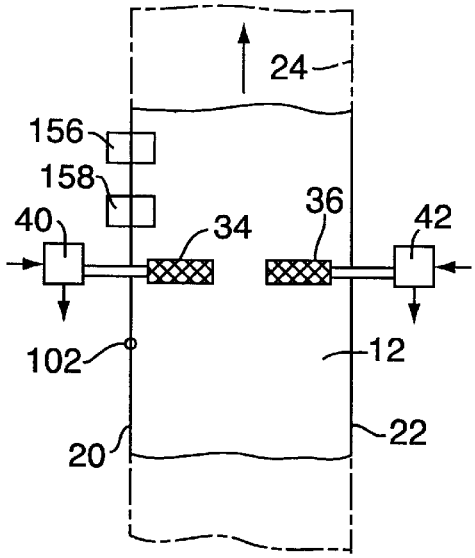
FIG. 13 is a schematic representation of another alternate embodiment of the edge detection system with the strip material moving along the feed path in the drive apparatus of FIG. 1.

Referring to FIG. 13, another alternate embodiment uses a pair of sensors 156, 158 disposed at predetermined positions in front of the friction wheels 34, 36, as viewed in the direction of motion of the strip material 12. A steering reference point 102 is defined at a predetermined distance behind the friction wheels, as viewed in the direction of motion of the strip material 12. Based on the inputs from sensors 156, 158, the processor 54 determines a lateral error at the steering reference point 102. If it is determined that there is no error at the steering reference point 102, the friction wheels are driven simultaneously. However, if it is determined that there is a skewing or lateral error at the steering reference point 102, the processor 54 steers the motor drives and subsequently the friction wheels to straighten the strip material 12 in the manner described above.

The present invention provides a method and apparatus for automatically aligning the strip material 12 in the friction drive apparatus 10. This eliminates the need for an operator to manually align the strip material 12. Typically, manual alignment results in excessive amounts of wasted strip material and does not always provide error free final graphic products. Therefore, the automatic alignment procedure of the present invention translates into savings of operator time, strip material savings and improved quality of the final graphic product. The calibration procedure of the present invention provides additional accuracy to the proper alignment of the strip material and improves quality of the final graphic product.

The sensors 56, 58, 156, 158 used in the preferred embodiment of the present invention are digital sensors. One type of digital sensor that can be used is a linear sensor array model number TSL401, manufactured by Texas Instruments, Inc., having a place of business at Dallas, Tex. In another embodiment of the present invention, large area diffuse sensors can be used with A/D converters replacing the pulse shaper and serial to parallel connector. These sensors preferably have an output proportional to the illuminated area. This can be accomplished with the photoresistive sensors, such as Clairex type CL700 Series and simple No. 47 lamps. Alternatively, a silicon photo diode can be used with a diffuser-window about one half of an inch (½") in diameter and a plastic lens to focus the window on the sensitive area of the diode, which-is usually quite small compared to the window. Still other types of optical, magnetic, capacitive or mechanical sensors can be used. The light source 66, 68 is either a Light Emitting Device (LED) or a laser.

While a variety of general purpose micro processors can be used to implement the present invention, the preferred embodiment of the present invention uses a microprocessor and a Digital Signal Processor (DSP). One type of the microprocessor that can be used is a microprocessor model number MC68360 and a digital signal processor model number DSP56303, both manufactured by Motorola, Inc., having a place of business in Austin, Tex.

Although the preferred embodiment of the present invention depicts the apparatus 10 having the friction wheels 34, 36 disposed within the bottom portion 14 and the pinch rollers 30 disposed within the top portion 16, the location of the friction wheels 34, 36 and pinch rollers 30 can be reversed. Similarly, the sensors 56, 58 can be disposed within the top portion 16 of the apparatus. Moreover, although the wheels 34, 36 are referred to as friction wheels throughout the specification, it will be understood by those skilled in the pertinent art that the wheels 34, 36 can be either friction, embossed, grit, grid or any other type of wheel that engages the strip material. Furthermore, although FIG. 7 depicts the strip material 12 being loaded up against stops 82, 84, the strip material can be placed at any location over the sensors 56, 58 and the strip material will be aligned.

Figure 14:
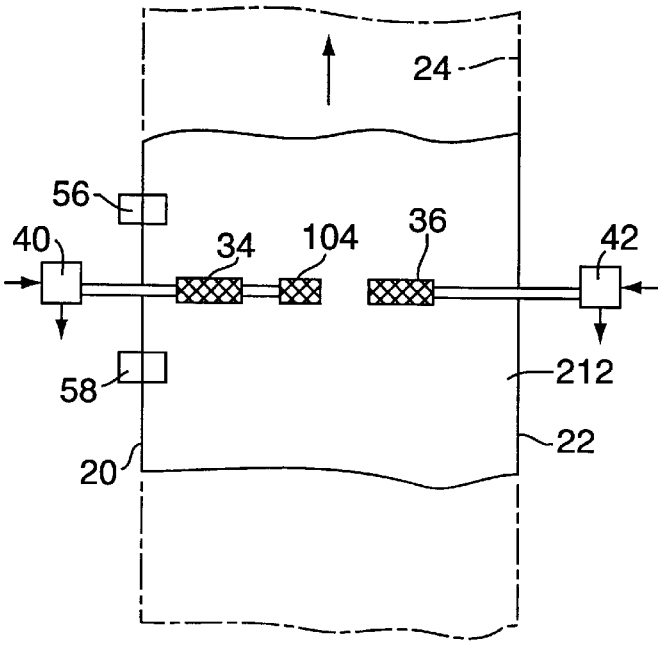
FIG. 14 is a schematic representation of a wide strip material moving along the feed path in the drive apparatus of FIG. 1.

Although FIGS. 3–6 show one friction wheel associated with each longitudinal edge of the strip material, a lesser or greater number of friction wheels driving the strip material can be used. Referring to FIG. 14, for wide strip material 212 used with larger printers, plotters and/or cutters, in the preferred mode of the present invention, a third friction wheel 104 is used to drive the middle portion of the strip material 212. The third friction wheel 104 is coupled to the first friction wheel 34. The force of the pinch roller 30, shown in FIG. 1, corresponding to the third friction wheel 104, is lower to avoid interference with the lateral steering of the strip material 212. However, the third friction wheel 104 is activated to reduce longitudinal positional error of the strip material 212.

While the present invention has been illustrated and described with respect to a particular embodiment thereof, it should be appreciated by those of ordinary skill in the art, that various modifications to this invention may be made without departing from the spirit and scope of the present invention. For example, predetermined calibration and aligning distances can vary. Also, although the preferred embodiment of the present invention provides stops 82, 84 for ensuring that the strip material is positioned over the sensors 56, 58 when the strip material 12 is placed into the friction drive apparatus 10, the stops 82, 84 are not necessary as long as the longitudinal edge 20 of the strip material 12 or the edge 99 of the stripe 100 of the strip material 12 is positioned over the controlling sensor. Additionally, the aligning function can be performed when the Y-axis position of the longitudinal edge of the strip material is taken either continuously or intermittently and the steering of the strip material does not need to be performed simultaneously with the Y-axis position measurement. Similarly, the aligning method can be performed regardless whether the strip material is moved continuously or intermittently in the course of a work operation.

We claim:

1. A method for calibrating an edge detection system in a friction drive apparatus, said method comprising the steps of:

moving a strip material a predetermined calibration distance in a forward X-axis direction;

establishing a first sensor forward position of said strip material with respect to a first sensor;

establishing a second sensor forward position of said strip material with respect to a second sensor;

calculating a first difference between said first sensor forward position and said second sensor forward position to define a sensor adjustment; and adjusting a center reference position of said second sensor by said sensor adjustment to calibrate said second sensor with respect to said first sensor so as to compensate for differences between outputs of said first sensor and said second sensor when said strip material is aligned.

2. The method according to claim 1 further comprising subsequent steps of:

incrementing a counter after determining that said first difference is substantially zero; and repeating above steps until said counter reaches a fixed predetermined number.

3. The method according to claim 1 further comprising the steps of:

incrementing said center reference position of said second sensor when said first difference is positive.

4. The method according to claim 1 further comprising the steps of:

decrementing said center reference position of said second sensor when said first difference is negative.

5. The method according to claim 1 further comprising a preceding step of:

saving an initial X-axis calibration position of said strip material.

6. The method according to claim 1 further comprising the steps of:

moving said strip material said predetermined calibration distance in reverse X-axis direction;

establishing a first sensor reverse position of said strip material with respect to said first sensor;

establishing a second sensor reverse position of said strip material with respect to said second sensor;

calculating a second difference between said first sensor reverse position and said second sensor reverse position; and calculating an average of said first difference and said second difference to define said sensor adjustment prior to said step of adjusting said center reference position of said second sensor.

7. The method according to claim 6 further comprising the steps of:

incrementing a counter after determining that said first difference and said second difference are substantially zero; and repeating steps prior to the counter incrementing step until said counter reaches five.

8. The method according to claim 6 further comprising the steps of:

incrementing said center reference position of said second sensor when said first difference and said second difference are positive.

9. The method according to claim 6 further comprising the steps of:

decrementing said center reference position of said second sensor when said first difference and said second difference are negative.

* * * * *